United States Patent [19]

Spruytenburg et al.

[11] Patent Number: 4,937,413

[45] Date of Patent: Jun. 26, 1990

[54] ACOUSTIC SENSOR ASSEMBLY FOR A MICROWAVE OVEN

[75] Inventors: Fred T. Spruytenburg; Charles McDonald, both of Memphis; Michael J. Hodgetts, Germantown, all of Tenn.

[73] Assignee: Microwave Products of America, Inc., Memphis, Tenn.

[21] Appl. No.: 395,020

[22] Filed: Aug. 17, 1989

Related U.S. Application Data

[62] Division of Ser. No. 113,646, Oct. 26, 1987, Pat. No. 4,873,409.

[51] Int. Cl.[5] ..... H05B 6/80

[52] U.S. Cl. ..... 219/10.55 B; 219/10.55 E; 73/632; 340/384 R

[58] Field of Search ..... 219/10.55 B, 10.55 R, 219/10.55 M, 10.55 E, 506, 509, 497; 340/384 R, 385; 99/323.7, 323.5, 325, 327, 328, 451, DIG. 14, 493; 426/234, 241, 243, 107, 113; 73/632

[56] References Cited

U.S. PATENT DOCUMENTS

| | | | |
|---|---|---|---|
| 3,467,804 | 9/1969 | Smith | 219/10.55 B |
| 3,931,757 | 1/1976 | Goode | 99/323.11 |
| 4,381,439 | 4/1983 | Miyazawa et al. | 219/10.55 B |
| 4,520,250 | 5/1985 | Ishihara et al. | 219/10.55 E |
| 4,602,147 | 7/1986 | Gell | 219/509 |
| 4,672,180 | 6/1987 | Kusunoki et al. | 219/10.55 B |

*Primary Examiner*—Philip H. Leung

*Attorney, Agent, or Firm*—Senniger, Powers, Leavitt and Roedel

[57] ABSTRACT

An acoustic sensor assembly for a microwave oven of the type having an oven cavity defined by walls. The acoustic sensor assembly comprises an acoustic sensor for converting sound into an electrical signal representative thereof, and aperture in the wall of the microwave oven cavity of sufficiently small to prevent microwaves from passing therethrough. The assembly further includes a hollow conduit, for example a plastic tube, having first and second ends and secured to the aperture at the first end and to the sensor at the second end for acoustically coupling the sensor to the aperture such that sounds in the cavity are passed through the aperture to the sensor.

6 Claims, 5 Drawing Sheets

ACOUSTIC SENSOR ASSEMBLY FOR A MICROWAVE OVEN

This is a division of application Ser. No. 07/113,646 filed Oct. 26, 1987, now U.S. Pat. No. 4,873,409, issued Oct. 10, 1989.

BACKGROUND OF THE INVENTION

In the past, popcorn has been popped in microwave ovens with somewhat limited success. One approach has been to apply microwaves for a fixed period of time. This approach typically resulted in a substantially large number of unpopped kernels if too short or in scorching of the popped popcorn if the fixed time period was too long for the specific batch of popcorn placed in the oven. Because of the batch to batch variability, a fixed period of time that is optimum for one batch may over or under-cook another batch of the "same" type of popcorn.

Another approach has been to instruct a microwave oven user (for example on instructions on the container of popcorn specifically packaged for microwave popping) to listen to the popcorn popping and shut the oven off when popping slows down. For example, one instruction says to stop microwave when rapid popping slows to two to three seconds between pops. That same instruction says that the time will range from two to five minutes. This approach requires that the microwave oven user be present during the entire popping cycle and further that the user focus close attention to the popping. This method also suffers from variability in that the user is unlikely to precisely time the two to three second Onterval resulting in user-to-user variability and even batch-to-batch variability with the same user, at least until that user has acquired the experience to know when to stop the oven.

SUMMARY OF THE INVENTION

The present invention overcomes the disadvantages of the prior approaches to popping popcorn in a microwave oven by providing an automatic closed-loop control for the popping cycle. The control monitors and time averages the popping, and shuts the oven off to avoid scorching the popped corn when the rate of popping slows down to a rate corresponding to the effective completion of popping.

DETAILED DESCRIPTION

Figure 1:
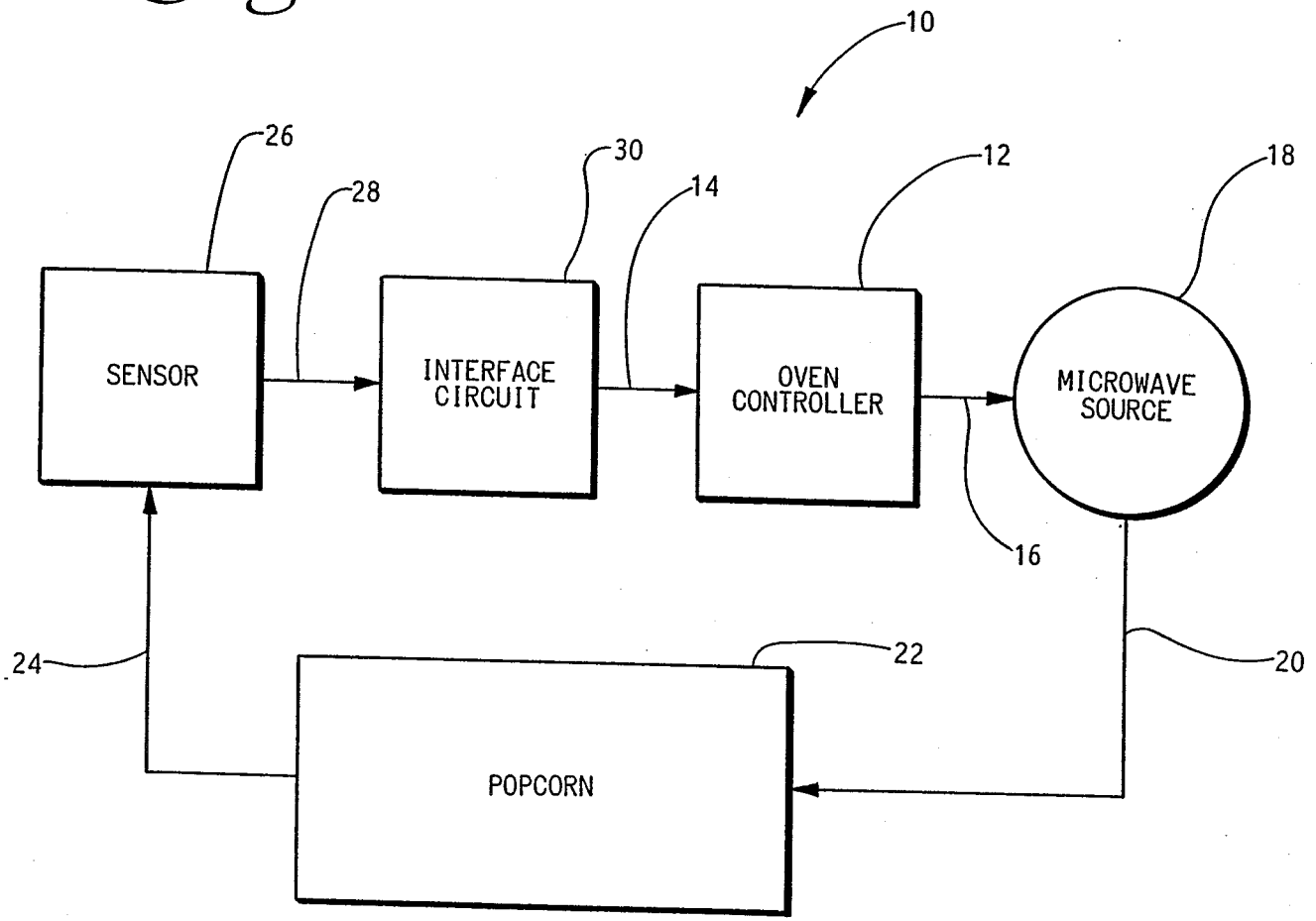
FIG. 1 shows the closed-loop block diagram of the present invention in combination with elements of a microwave oven and popcorn load.

Referring now to FIG. 1, a closed-loop control 10 for sensing the completion of popcorn popping in a microwave oven is shown in block diagram form. The control loop includes an oven controller 12 which may be either electro-mechanical or electronic, provided that it is responsive to a shut off command at input 14. Controller 12 has an output 16 to control a microwave source 18, such as a magnetron. When magnetron 18 is commanded "on" by the signal on line 16, microwave energy, indicated by arrow 20, is applied to a popcorn load 22 located in the microwave oven cavity (not shown). As popcorn 22 receives microwave energy 20, it commences poppinq, emitting acoustic energy 24 in the form of "pops" or impulses of sound. Energy 24 is coupled to an acoustic sensor or sound transducer 26 which provides an electrical output 28 representative of the energy 24. An interface circuit 30 has an input which receives the signal on line 28 and processes it so as to automatically provide a shut-off signal on line 14 when popcorn 22 is done popping, indicated by an end rate corresponding to the effective completion of popping. Because not every kernel in a batch can be popped without scorching the kernels already popped, the shut-off signal is made responsive to a decreasing level of popping of popcorn in the oven.

Figure 2:
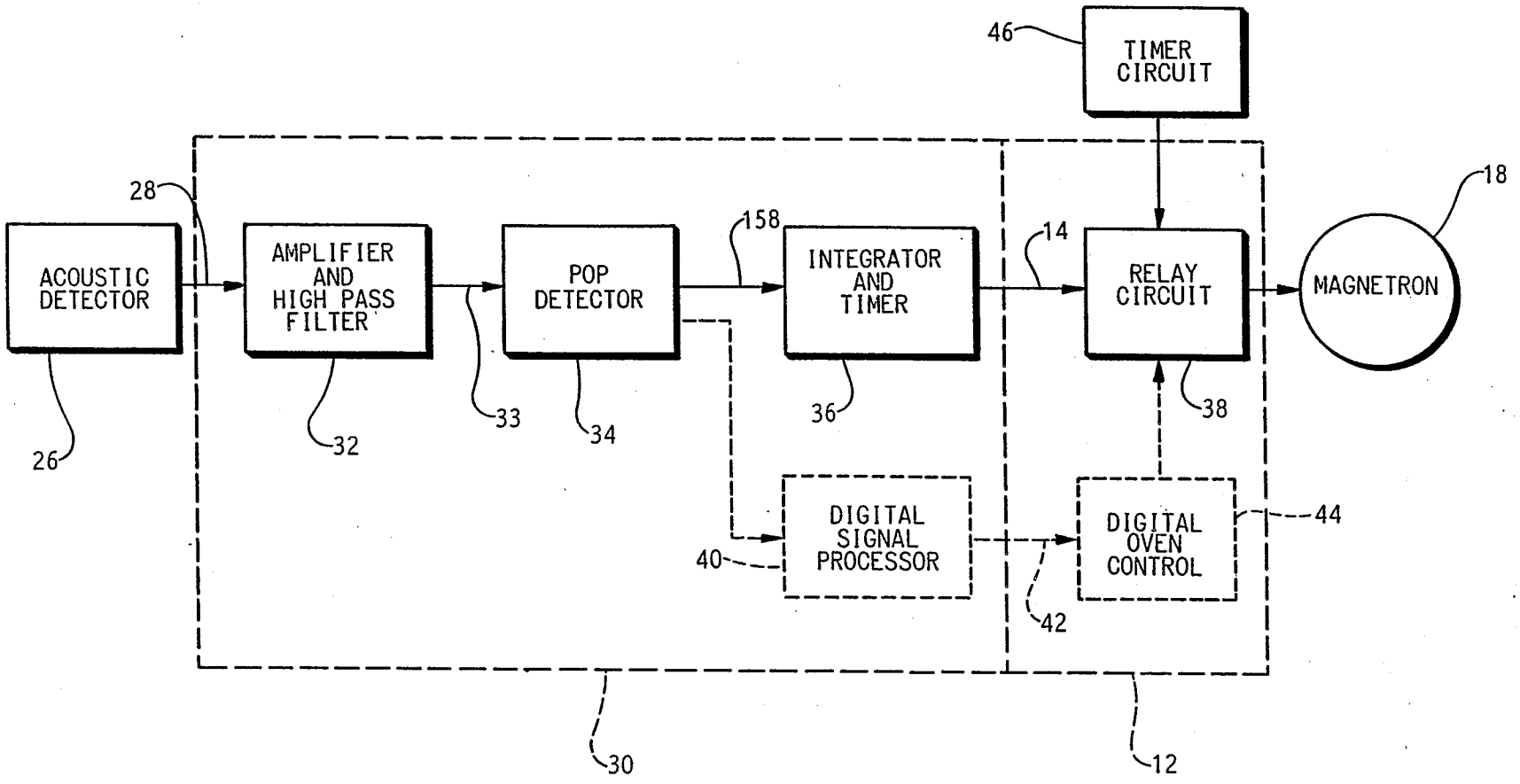
FIG. 2 shows a more detailed block diagram of an electronic control embodiment of the present invention including an alternative flow path for digital oven controls.

Referring now more particularly to FIG. 2, a portion of the control loop of FIG. 1 is shown in a more detailed block diagram. Specifically, interface circuit 30 may include an amplifier and high-pass filter block 32, a pop detector block 34, and an integrator and timer block 36. Oven controller 12 may be an electro-mechanical type, or may be a digital electronic control. If the microwave source 18 is a magnetron, controller 12 will ordinarily include a relay circuit 38 to interrupt high voltage to the magnetron. As an alternative to integrator and timer block 36, a digital signal processor 40 may be utilized to provide an appropriate command signal on line 42 to a microprocessor in a digital oven control 44. An additional timer circuit 46 may be utilized to shut off the microwave oven after a period of time set longer than the popcorn popping cycle to protect against extended oven operation in the event the oven is started without a batch of popcorn in the cavity.

Figure 3:
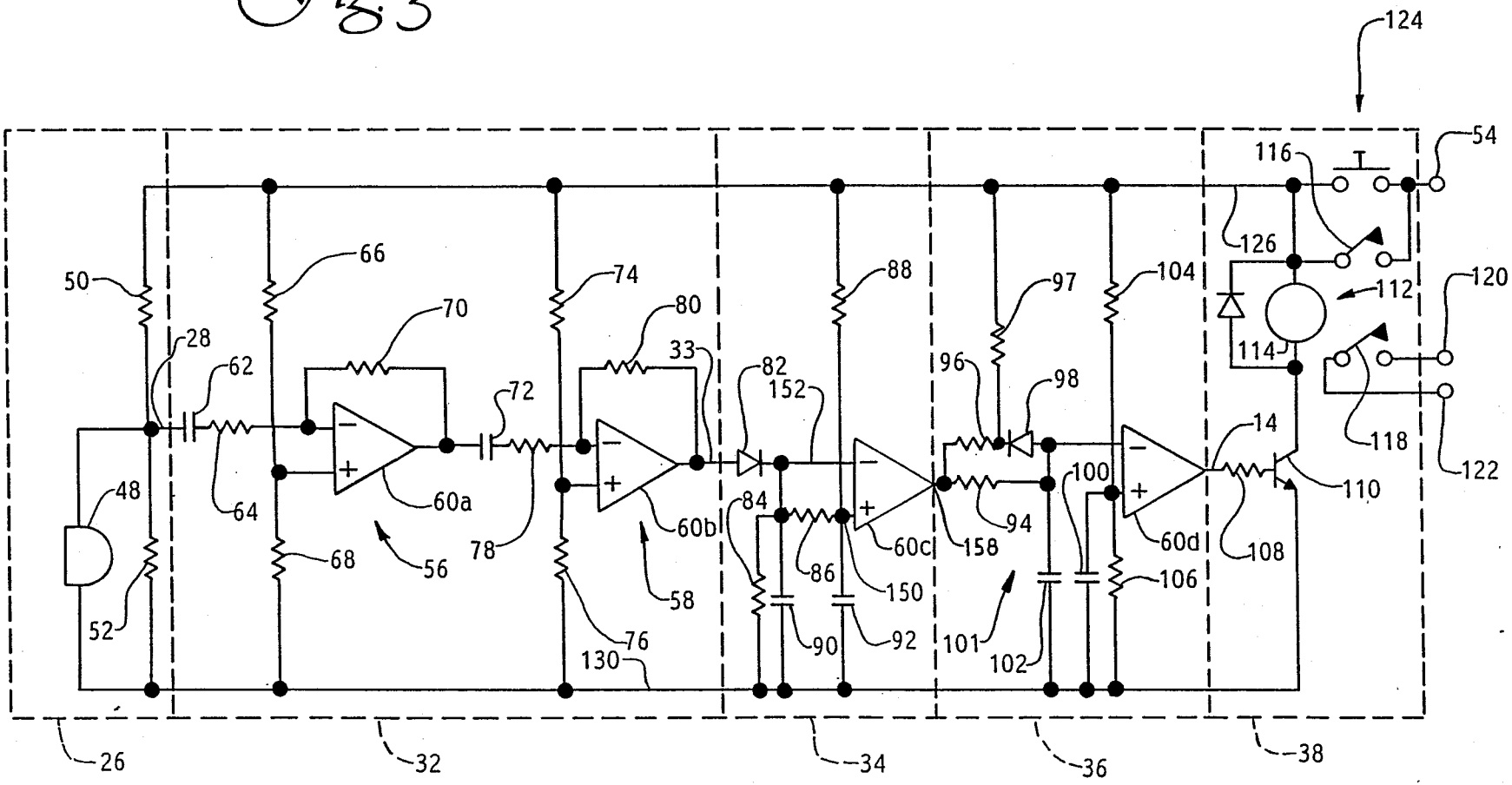
FIG. 3 shows a detailed schematic of the embodiment of FIG. 2 of the present invention.

Referring now more particularly to FIG. 3, a detailed schematic of portions of the embodiment of FIG. 2 may be seen. In this embodiment, acoustic detector 26 includes an electret microphone 48 which may be Panasonic part number WM-034AY. Microphone 48 is biased by resistor 50, preferably 3 K (ohmS) and resistor 52, preferably 1.5 K. It is to be understood that in this embodiment, power is preferably supplied at +15 volts DC through terminal 54.

Amplifier and filter block 32 preferably includes two amplifier stages 56, 58 each in the form of a first-order high pass filter. A type LM324 quad operational amplifier integrated circuit having four high gain amplifiers 60 *a–d*, available from National Semiconductor, has been found suitable for use in this application. Stage 56 includes a 0.01 uf capacitor 62, a 100 K resistor 64, two 2 MEG (ohm) resistors 66, 68, a 1 MEG resistor 70 and amplifier 60*a*. Capacitor 62 and resistor 64 form a combined impedance which provides for a first order high pass filter characteristic. The gain of stage 56 is set by the ratio of the resistance of resistor 70 to the input impedance formed by the series combination of capacitor 62 and resistor 64. Amplifier 60a is biased for Class A operation by resistors 66, 68.

Stage 58 includes a 0.01 uf capacitor 72, two 2 MEG resistors 74, 76, a 100 K resistor 78, a 1 MEG resistor 80, and amplifier 60b. The elements of stage 58 perform in a similar fashion to those of stage 56.

Pop detector 34 preferably includes a conventional diode 82, such as a 1N914, a 1 MEG resistor 84, a 1.8 MEG resistor 86, a 10 MEG resistor 88, a 0.22 uf capacitor 90, a 0.1 uf capacitor 92 amplifier 60c connected as a comparator. As will be explained in more detail below, capacitors 90 and 92 provide a "floating reference" network for comparator 60c in order to enable comparator 60c to discriminate popcorn popping impulses from any remaining background noise in the signal on line 33 which may be caused by the cooling fan and other components. Resistors B4, 86 and B8 provide a biasing and discharge network at the input to comparator 60c.

The integrator and timer block 36 preferably includes a 910 K resistor 94, a 33 K resistor 96, a 39 K 1N914 resistor 97, a diode 98, a 0.1 uf capacitor 100, a 150 uf capacitor 102, a 1 MEG resistor 104, a 1.2 MEG resistor 106, and amplifier 60d connected as a comparator. Capacitor 102 and resistor 94 form a relatively long time constant RC type integrator which integrates up in a first direction when output 158 of comparator 60c is high. Resistors 104, 106 set a trip point for comparator 60d at a voltage approximately equal to the voltage which would appear across capacitor 102 after one time constant of the combination of capacitor 102 and resistor 94. After some integration in the first direction, Resistors 96 and 97 and diode 98 provide a rapid discharge path for capacitor 102 when output 158 is low. The asymptotic value for the discharge, which may be thought of as integrating in a second direction, is set by a voltage divider formed by resisters 96, 97.

Relay circuit 38 preferably includes a 3 K resistor 108, a conventional NpN switching transistor 110, and a relay 112 with a coil 114, a normally-open low voltage contact 116, and a normally-open high voltage contact 118. It is to be understood that contact 118 is connected in the high voltage supply to the magnetron via terminals 120, 122. A normally-open, momentary action switch 124 is connected between the +15 V DC supply 54 and the +V bus 126. It is to be understood that the oven will be "on" whenever relay 112 is energized and that relay 112 is initially energized, along with the remainder of the elements shown in FIG. 3 upon closure of switch 124.

The operation of control 10 in a popcorn poppinq cycle is as follows: power is supplied to bus 126 when switch 124 is closed and is maintained through contact 116 when switch 124 is released. Initially, even though microwave energy is applied for an initial time period, which may be fixed, there is no popcorn popping, and no pulses are detected by pop detector 34. Output 158 remains high, as does output 14 of comparator 60d, holding transistor 110 on, thus energizing relay 112. Sound transducer microphone 48 monitors the audible popping once it commences and provides an electrical signal on line 28, which is amplified and filtered by stages 56, 58 thus removing background noise from the signal representing the sound of popcorn popping in the microwave oven.

Capacitor 90 in pop detector 34 charges rapidly upon the occurrence of an impulse generated upon an instance of a kernel of corn popping in the oven. Capacitor 90 and 92 will "track" low frequency noise which may appear at the input to diode 82. Resistor 84 provides a discharge path for capacitor 90 to circuit common 130. The combination of resistors 84, 86 and 88 provide a voltage divider bias network for comparator 60c to provide a minimum threshold for a pop impulse, to avoid false switching of comparator 60c.

Circuit 36 includes a combined RC-type integrator and timer, followed by comparator 60d. In the absence of popping, the output of comparator 60c is held at a fixed level, close to the voltage on bus 126. When the output of comparator of 60c is at this level, capacitor 102 charges up in a first direction through resistor 94. While output 158 remains high, capacitor 102 charges at a rate set by resistor 94. When the voltage on capacitor on 102 exceeds the voltage at the plus summing junction of comparator 60d, the output 14 of comparator 60d switches low, shutting off transistor 110 and de-energizing relay 112. Ordinarily however, popping will occur before the voltage on capacitor 102 rises sufficiently to switch comparator 60d. When popping occurs, the output of comparator 60c is momentarily driven low, discharging capacitor 102. This delays switching of comparator 60d until popping slows to an end rate corresponding to the effective completion of popping. Once popping slows to this rate the output of comparator 60d will switch low, turning off transistor 110 and relay 112 by removing current from coil 114, thus opening contacts 116 and 118 and shutting off the oven. It is to be understood that the microwave oven controller 12 is deactivated when the time rate of popping of individual kernels of popcorn falls below a predetermined value.

Figure 4:
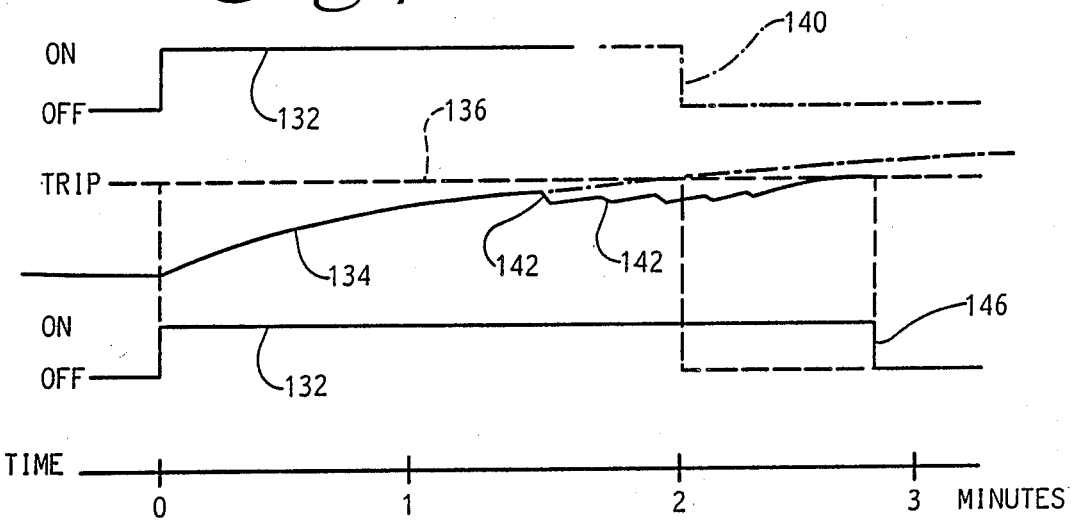
FIG. 4 shows waveforms corresponding to and illustrating the operation of FIG. 3.
Figure 5:
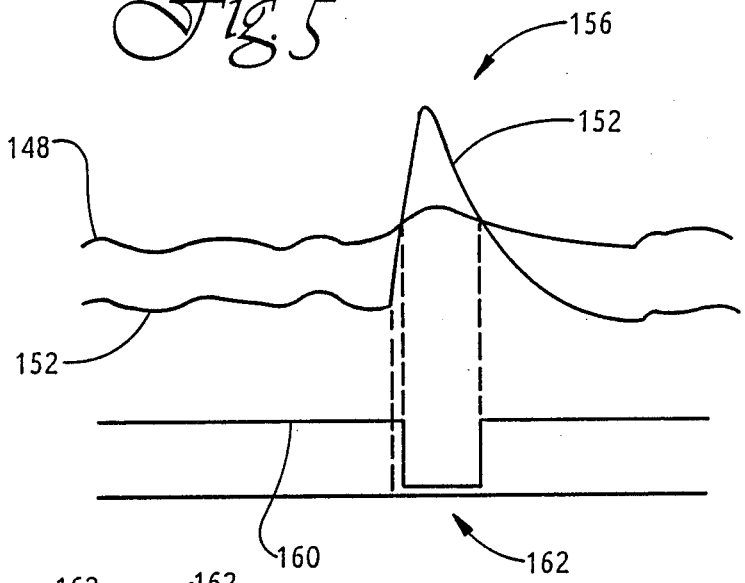
FIG. 5 shows an expanded view of the operation of the pop detector of FIGS. 2 and 3.
Figure 6:
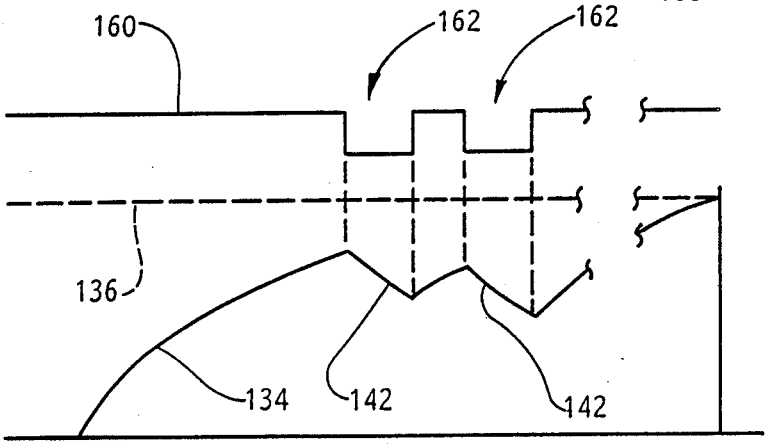
FIG. 6 shows an expanded view of a portion of FIG. 4 in connection with a waveform corresponding to FIG. 5.

Referring now also to FIGS. 4, 5 and 6 in addition to FIGS. 2 and 3, a pre-pop timer function is incorporated in block 36. This function, illustrated by waveform 132 is combined with the RC integrator 101 in block 36. Capacitor 102 of the RC integrator 101 begins to charge up as shown in waveform 134. While capacitor 102 is charging along exponential voltage rise 134, relay 112 is "on" as shown by waveform 132. In the absence of popping, waveform 134 will continue charging until trip point 136 of comparator 60d is reached, at which time relay 112 will switch "off" as shown at transition 140. If, however, popping commences before the timer of block 36 reaches transition 140, the integrator of block 36 will be partially reset by the action of comparator 60c acting through resistors 94, 96, 97 and diode 98, extending the time for the integrator 101 to reach the predetermined level 136. This partial resetting is indicated by segments 142 in waveform 134. It is to be understood that integration in the first direction is at a rate substantially slower than the rate of integration in the second direction. Waveform 134 is thus held below trip level 136 until popping slows down indicating the end of the popping cycle. Because the integrator in block 36 is partially reset, the relay 112 will not switch off at transition 140, but, instead, will switch off at transition 146 when the output 114 of comparator 60d switches from high to low. This partial resetting of the integrator of block 36 performs a time averaging function on the intervals between popping since the integrator capacitor 102 integrates down during each pop impulse and up in the intervals between pop impulses.

Referring now also to FIG. 5, the operation of pop detector 34 is illustrated. It is to be understood that because of capacitors 90 and 92 and resistor 86, the voltages at the positive and negative summing junctions of comparator 60c will track each other with an offset for a slowly changing signal at the output of block 32. This is illustrated by waveforms 148, 152 corresponding to the voltages at the positive and negative summing junctions 150, 154 respectively of comparator 60cWhen a pop is sensed by detector 26 and amplified by block 32, an impulse 156 will occur at the negative summing junction 154 of comparator 60c. When the voltage of waveform 152 exceeds that of waveform 148, the output 158 of pop detector 34 will transition from a high to a low state, illustrated by waveform 160. It is to be understood that the width of pulse 162 in waveform 160 is determined by both the height and the width of pop impulse 156. Each pulse 162 output from pop detector 34 causes a partial resetting or integrating down in a second direction of the integrator in block 36, as illustrated by segments 142 of waveform 134 in FIG. 6. Once popping slows down sufficiently for waveform 134 to reach trip level 136, block 36 provides a shut down or shut off command to the oven by switching comparator 60dfrom a high to a low state output as described above.

Figure 7:
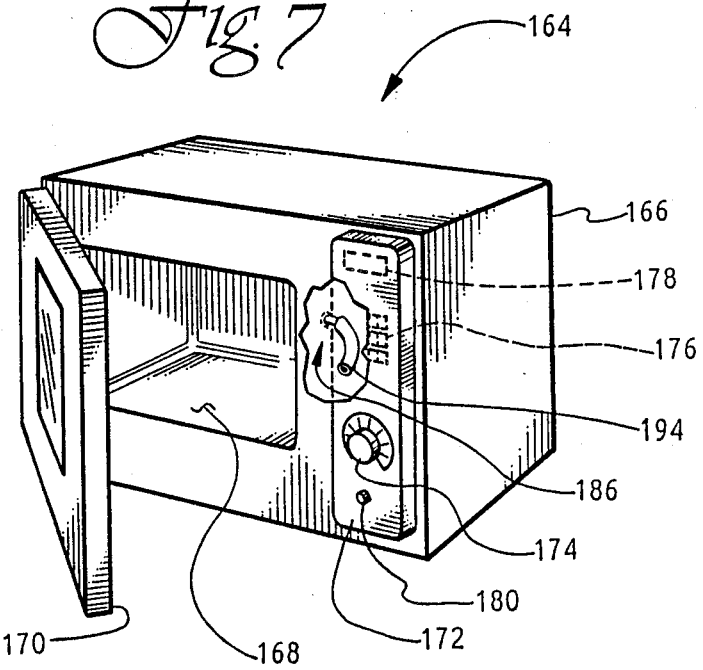
FIG. 7 is a partially cutaway view of a microwave oven illustrating certain mechanical aspects of the present invention.

Referring now to FIG. 7, a microwave oven 164 which utilizes the present invention may be seen partially cut away. Oven 164 has a housing 166 containing a cavity 168 and a door 170. Typically oven 164 will include a control panel 172 which will have either a mechanical control input 174 such as a knob, or an electronic control input 176 such as a keyboard. Panel 172 may also have a display 178. Oven 164 preferably has a start button 180 accessible to a user of the microwave oven 164 to initiate operation of the oven by actuating switch 124.

Figure 8:
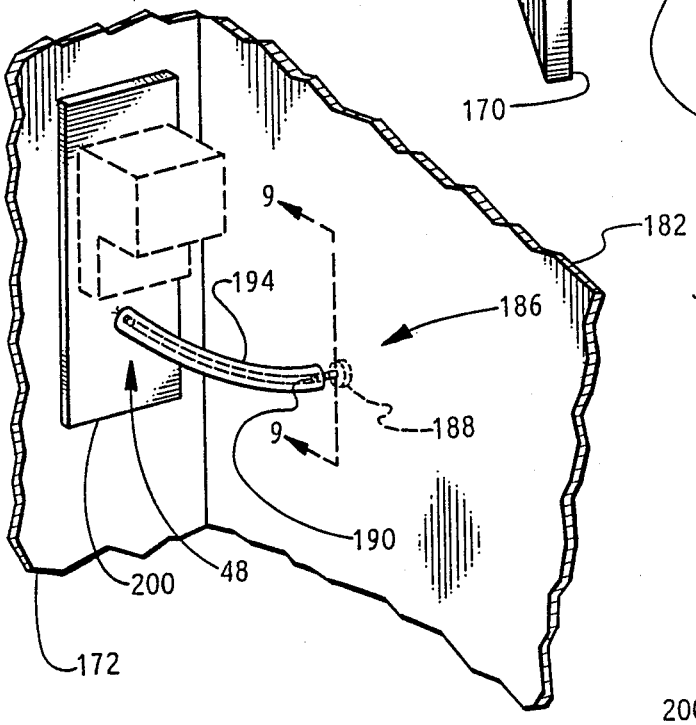
FIG. 8 is an enlarged cutaway view of a portion of the interior of the oven of FIG. 7.
Figure 9:
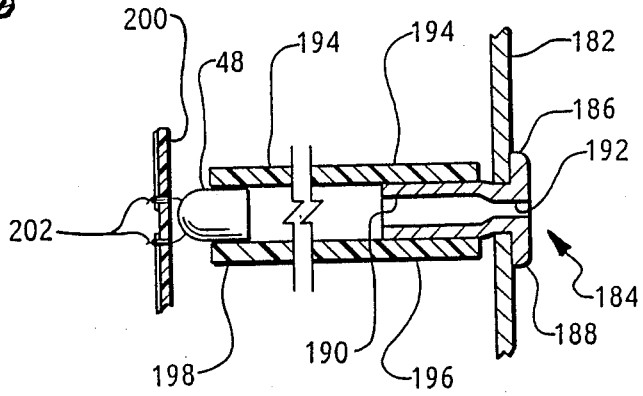
FIG. 9 is a partial section view taken along line 9—9 of FIG. 8.

Referring now also to FIGS. 8 and 9, cavity 168 has an interior wall 182 having an aperture 184 therein. Preferably, aperture 184 has a hollow rivet-like structure 186 having a flange 188 interior of the cavity and a projection 190 exterior of the cavity. Projection 190 may be swaged or enlarged to lock structure 186 to wall 182. It is to be understood that structure 186 is preferably metallic and contains a hollow internal region 192 of sufficiently small cross section to prevent the passage of microwaves therethrough thus functioning as a waveguide beyond cutoff. A first end 196 of a hollow tube or conduit 194 is received on projection 190. Tube 194 is preferably formed of flexible plastic suitable for coupling acoustic energy from aperture 184 to sensor 26. A second end 198 of tube 194 is received on microphone 48 which in one embodiment is preferably mounted to a printed circuit board 200 which may contain additional components of the microwave oven controller 12 and interface 30. Alternatively, aperture 184 may be used without structure 186, in which event aperture 184 is to be of sufficiently small cross section to prevent passage of microwaves. Tube 194 may be fastened to wall 182 in any suitable fashion, for example by adhesive, if desired.

Utilizing the structure of a hollow tube 194 or its equivalent permits convenient placement of sensor 48 while still maintaining acoustic coupling between sensor 48 and the aperture 184 in cavity wall 182. Utilizing structure 186 or an equivalent functioning as a waveguide beyond cutoff prevents microwave energy from reaching pickup or detector 48 and thus prevents microwave energy from interfering with the operation of detector 48. Alternatively, detector 48 may be located in close proximity to projection 190, with electrical leads 202 on detector 48 extending to board 200.

The invention is not to be taken as limited to all of the details thereof as modifications and variations thereof may be made without departing from the spirit or scope of the invention.

What is claimed is:

1. An acoustic sensor assembly for a microwave oven of the type having an oven cavity defined by walls, the sensor assembly comprising:

(a) an acoustic sensor for converting sound into an electrical signal representative thereof;

(b) means for defining an aperture in the wall of the microwave oven cavity the aperture being of sufficiently small cross section to prevent microwaves from passing therethrough; and (c) coupling means for acoustically coupling the sensor to the aperture such that sounds in the cavity are passed through the aperture to the sensor, the coupling means comprising a hollow conduit having first and second ends and secured to the aperture at the first end and to the sensor at the second end.

2. The sensor assembly of claim 1 wherein the hollow conduit comprises a plastic tube.

3. The sensor assembly of claim 1 wherein the coupling means further comprises a hollow metallic projection exterior of the cavity wall and in communication with the aperture.

4. The sensor assembly of claim 3 wherein the hollow projection further comprises a structure operating as a waveguide beyond cutoff.

5. The sensor assembly according to claim 1 wherein the acoustic sensor is mounted on a circuit board.

6. The sensor assembly according to claim 5 wherein the first end of the hollow conduit is fit over the acoustic sensor on the circuit board.

* * * * *